United States Patent [19]

Marley

[11] Patent Number: 4,573,232

[45] Date of Patent: Mar. 4, 1986

[54] MECHANICAL CHIMNEY SWEEP CONTROL

[76] Inventor: Clement F. Marley, R.R. 2 Box 165, Nokomis, Ill. 62075

[21] Appl. No.: 651,169

[22] Filed: Sep. 17, 1984

[51] Int. Cl.[4] ..... F23J 3/00

[52] U.S. Cl. ..... 15/163

[58] Field of Search ..... 15/162, 163, 242, 243, 15/249

[56] References Cited

U.S. PATENT DOCUMENTS 1,104,030 7/1914 Willat ..... 15/163 X
1,320,887 11/1919 Michels, Sr. ..... 15/249
4,365,382 12/1982 Korfmann et al. ..... 15/243 X

FOREIGN PATENT DOCUMENTS 3242786 5/1984 Fed. Rep. of Germany ..... 15/162

*Primary Examiner*—Peter Feldman

[57] ABSTRACT

A device for controlling the brush in a remote-controlled chimney sweeping system. The device comprises a frame secured to the flue and extending above the flue for supporting and retaining the brush in alignment therewith and generally centered thereover. A flexible cable is provided for operating the brush from a remote position, whereby the brush may be lowered down the flue and then drawn back up the flue from a convenient operating position remote from the top of the flue. Alternate control devices are used to channel direction of the cable. One such device is a two-sided flange mounted atop the frame, with sets of bolts through the flange forming a race in an arc shape. The second device is a fabricated top plate with an arc made of tubing.

3 Claims, 3 Drawing Figures

MECHANICAL CHIMNEY SWEEP CONTROL

BACKGROUND OF THE INVENTION

This invention relates generally to a device for cleaning a flue, and more particularly to such a device which can be operated from a position remote from the top of the flue.

With the renewed interest in wood heat and the development of air-tight wood stoves, there has been a spin-off development in methods of venting those stoves, especially the use of metal flue pipes in place of the more conventional masonry flues.

Homeowners have used the newer stoves and the newer metal flues to install wood heat with more flexibility than in prior years. Homeowners no longer are restricted to locating stoves near masonry flues, but now can locate stoves virtually anywhere in the home.

This new freedom of location and the use of metal flue pipes has brought with it new problems in cleaning the soot from inside these flues, and doing it with the frequency needed to prevent harmful buildup to avoid the danger of flue fires.

In some northern climates, there are times when it is impossible to get on a roof to clean a flue in the conventional manner because there is an accumulation of snow and ice, or because of severe winds and extremely low chill factors. This could prevent the cleaning of the flue or chimney for many months when it is most needed due to constant use.

SUMMARY OF THE INVENTION

Among the several objects of this invention may be noted the provision of alternate devices to control the cable and brush which can be used without getting on the roof of a building and which are light in weight, yet self reinforcing to withstand considerable stresses, and which will operate trouble free, and yet which will knock down for packaging and shipping, and which will not cause any damage to the flue itself.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
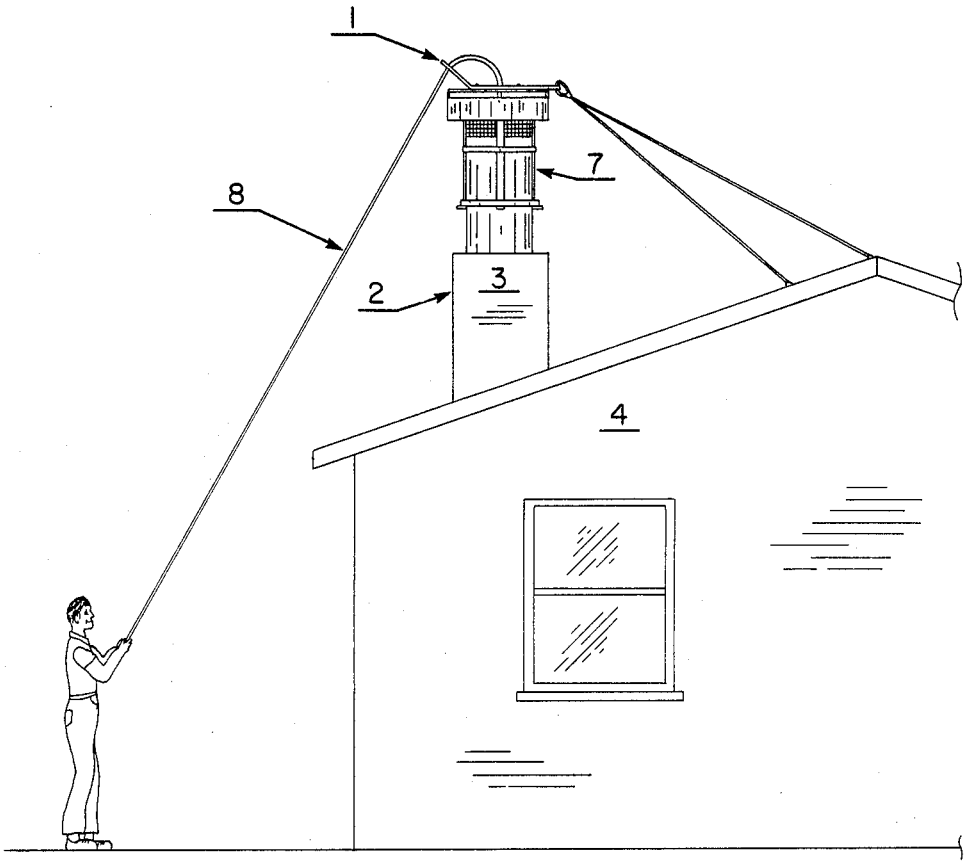
FIG. 1 is a side view of a flue cleaning device of this invention secured to a flue in a chimney of a house.

Referring now to the drawings, there is indicated at 1 a device for cleaning the inside of a flue 2. The device 1 is shown secured to the flue 2 of a chimney 3 which is built into the roof of house 4.

In accordance with this invention, the device 1 is provided for conveniently cleaning the inside surface 5 of the flue 2 from an operating position remote from the top of the flue. More particularly, the device 1 comprises a brush 6 and a frame 7 secured to the flue and extending above the flue for supporting and retaining brush 6 in alignment therewith and generally centered thereover. The device 1 further includes a cable 8 to operate brush 6 from a remote position.

Figure 2:
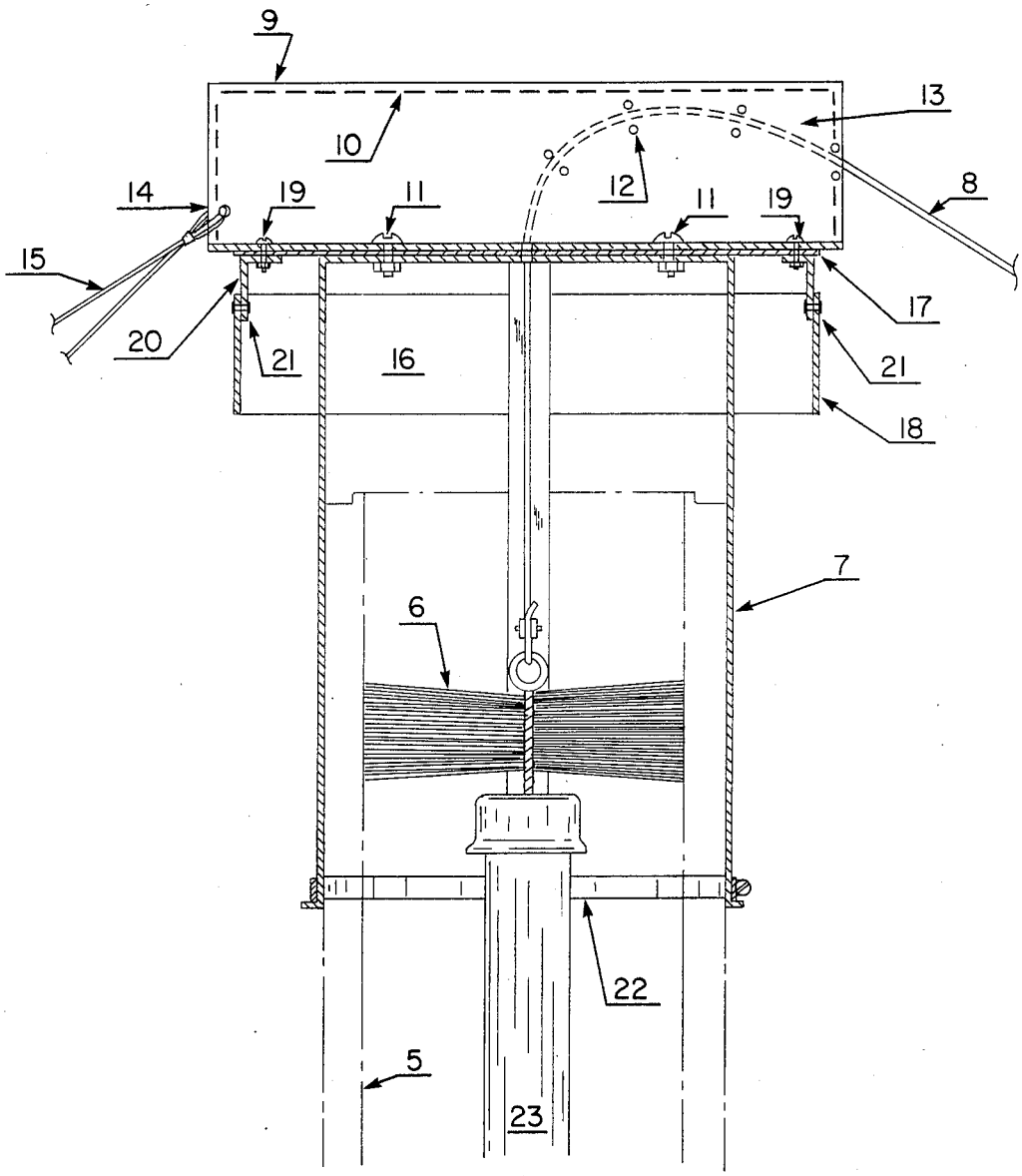
FIG. 2 is an enlarged vertical section through the center of the flue of FIG. 1 with parts broken away to show details of the flue and especially of the flange with cable race on top.

As shown in FIG. 2, flange 9 mounts vertically and horizontally on frame 7 held in place by bolts 11. Flange 9 has a back side of the same dimensions, dotted line 10. Pairs of bolts 12 form a race in an arc 13 to guide and control cable 8. Flange hole 14 provides grip for anchor cables 15.

Weather bonnet 16 is comprised of a top plate 17 and a skirt 18. Skirt is attached to top plate 17 by bolts 19. Right angle brackets 20 are riveted to skirt 18 by rivets 21.

Spiral band 22 holds frame 7 to chimney 2. Weight 23 pulls brush 6 down when cable 8 is released.

Figure 3:
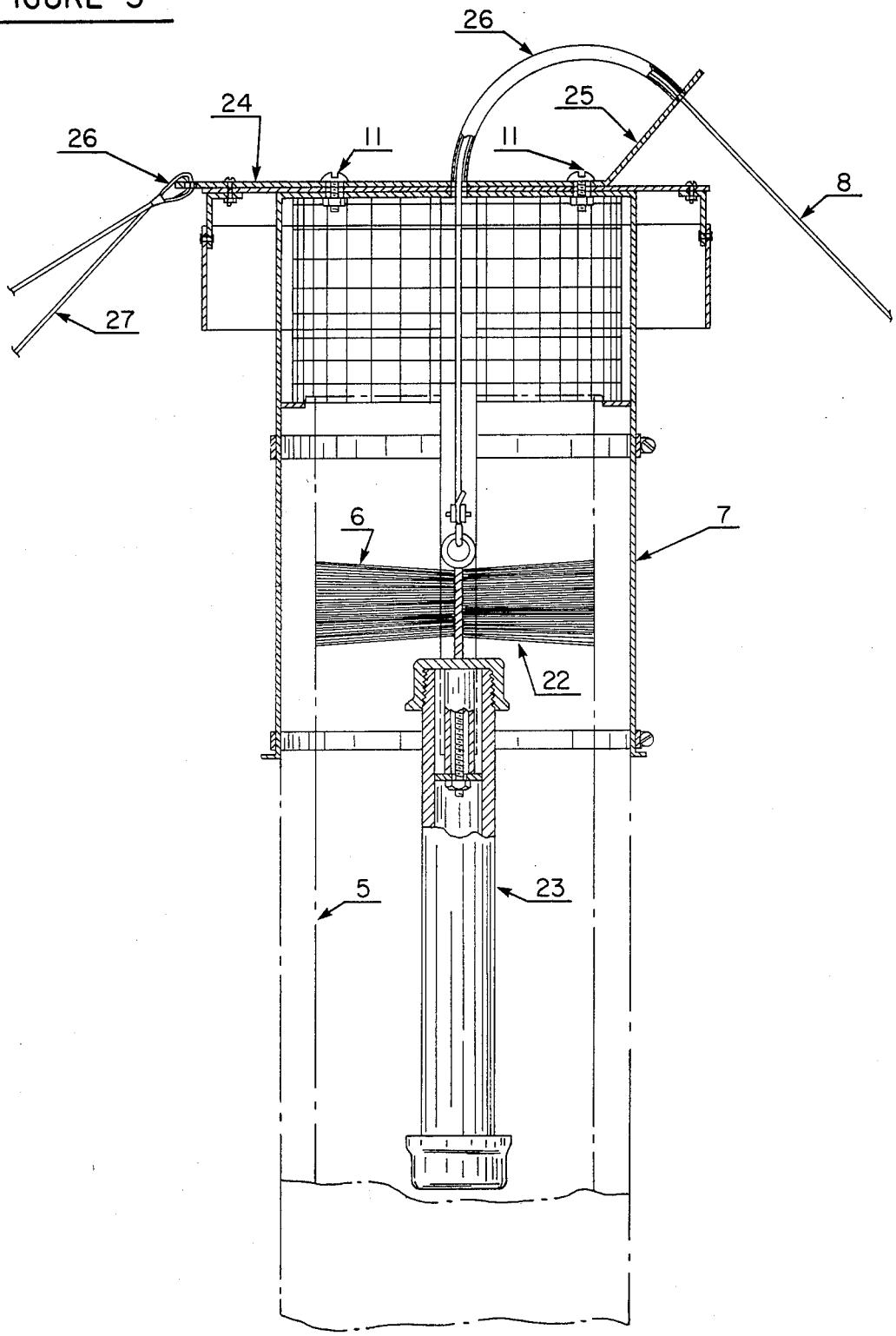
FIG. 3 is similar to FIG. 2 but with an inverted pipe loop for channeling the cable.

As shown in FIG. 3, bracket 24 has an approximate angle of 45 degrees bent at 25. Pipe loop 26, approximately 135 degrees is welded in an inverted position on bracket 24. Bracket 24 bolts to frame 7 with bolts 11. Cable 8 channels through the loop 26 to control brush 6. Anchor hole 26 at end of bracket provides grip for anchor cables 27.

What is claimed is:

1. A device for controlling a brush in a remotely controlled flue cleaner comprising a support means adapted to be secured to the upper outlet of the flue and to extend above the flue for supporting and retaining said brush in alignment therewith and generally centered thereover, a flange member including a pair of upstanding walls connected together at their bottom portions, said portions being connected to the top surface of said support means by bolt means, said two-walled flange member being spaced close together with only enough width between them to allow easy passage of an appropriate sized cable, a series of pairs of bolts extending through the walls of the flange member so as to permit easy passage of said cable, said series of bolts being arranged in a semi-circular pattern on one end of said flange member so as to form a race for passage of said cable and to transfer a downward pull on said cable to an upward pull on the brush, said support means having a bonnet means to keep out the weather, said bonnet means being connected to the bottom surface of said support means such that said bonnet means is located below said two-walled flange member, and means for anchoring the flange from the opposite end of the flange member so that the upper sections of the flue are not pulled over or not out of alignment when an operator is applying pressure to clean the flue.

2. A device for controlling a brush in a remotely controlled flue cleaner comprising a support means to be secured to the upper outlet of the flue and to extend above the flue for supporting and retaining said brush in alignment therewith and generally centered thereover, a unitized bracket attached to the top of said support means and being bolted to it, said bracket having a portion at one end thereof bent at an angle of approximately 45 degrees and provided with an anchor hole at the other end, a loop of pipe bent into an arc of approximately 135 degrees, the end of said pipe loop being welded to said bracket and said bent portion in order to form a channel for training cable therein so as to transfer a downward pull on said cable to an upward pull on the brush, said support means having a bonnet means to keep out the weather, said bonnet means being connected to the bottom of said support means such that said bonnet is located below said pipe loop, and means connected to said anchor hole for anchoring the bracket from the other end so that upper sections of the flue are not pulled over or out of line when an operator is applying pressure to clean flue.

3. A device as set forth in either claims 1 or 2 wherein said bonnet is constructed in two parts, one part defined as a single plate cover above said flue for modified weather control, and a second part being a metal skirt attached to said plate with angle brackets and bolts.

* * * * *